US005797228A

United States Patent [19]

Kemeny

[11] Patent Number: 5,797,228

[45] **Date of Patent: *Aug. 25, 1998**

[54] SEISMIC ISOLATION BEARING

[75] Inventor: Zoltan A. Kemeny, Tempe, Ariz.

[73] Assignee: Tekton, Tempe, Ariz.

[ * ] Notice: The term of this patent shall not extend beyond the expiration date of Pat. No. 5,490,356.

[21] Appl. No.: 649,584

[22] PCT Filed: Nov. 25, 1994

[86] PCT No.: PCT/US94/13598

§ 371 Date: Aug. 8, 1996

§ 102(e) Date: Aug. 8, 1996

[87] PCT Pub. No.: WO95/14830

PCT Pub. Date: Jun. 1, 1995

Related U.S. Application Data

[63] Continuation-in-part of Ser. No. 156,550, Nov. 24, 1993, Pat. No. 5,490,356.

[51] Int. Cl.[6] ..... E04B 1/98

[52] U.S. Cl. ..... 52/167.7; 52/167.8; 52/167.1; 52/741.3; 248/638; 248/632

[58] Field of Search ..... 52/167.1, 167.4, 52/167.7, 167.8, 741.3; 248/632, 638; 411/386, 388, 389

[56] References Cited

U.S. PATENT DOCUMENTS

| | | | |
|---|---|---|---|
| 2,660,386 | 11/1953 | Munro | 248/638 |
| 3,245,646 | 4/1966 | Bratoff | 248/632 |
| 3,430,901 | 3/1969 | Cauvin | 248/632 |
| 4,065,082 | 12/1977 | Oota | 248/632 |
| 4,117,737 | 10/1978 | Robinson | 52/167.1 |
| 4,463,753 | 8/1984 | Gustilo | 411/386 |
| 4,605,106 | 8/1986 | Fyfe et al. | 52/167.1 X |
| 4,633,628 | 1/1987 | Mostaghel | 52/167.7 |
| 4,644,714 | 2/1987 | Zayas | 52/167.4 |
| 4,713,917 | 12/1987 | Buckle et al. | 52/167.1 |
| 4,718,206 | 1/1988 | Fyfe et al. | 52/167.1 X |
| 4,727,695 | 3/1988 | Kemeny | 52/167.8 |
| 4,744,539 | 5/1988 | Stimeling | 248/632 |
| 4,823,522 | 4/1989 | White | 52/167.7 |
| 4,887,788 | 12/1989 | Fischert et al. | 248/632 X |
| 4,910,930 | 3/1990 | Way | 52/167.1 |
| 4,942,703 | 7/1990 | Nicolai | 52/167.7 |
| 5,215,382 | 6/1993 | Kemeny | 52/167.7 X |
| 5,242,147 | 9/1993 | Kemeny | 248/638 X |
| 5,339,580 | 8/1994 | Koshika et al. | 52/167.1 |

FOREIGN PATENT DOCUMENTS

| | | | |
|---|---|---|---|
| 443988 | 8/1991 | European Pat. Off. | 52/167.8 |

OTHER PUBLICATIONS

FIP Industrial (Italy Catalog).

*Primary Examiner*—Carl D. Friedman
*Assistant Examiner*—Winnie S. Yip
*Attorney, Agent, or Firm*—Snell & Wilmer L.L.P.

[57] ABSTRACT

A seismic isolation bearing including a top load plate (11A) for securing the bearing to a structure to be supported, a lower load plate (11B) for securing the bearing assembly to the foundation, and a steel reinforced rubber bearing body (13) sandwiched therebetween. The rubber bearing body (13) performs the bearing and restorative functions of the seismic isolation bearing. A steel midplate (14) extends radially from the middle of the bearing body laminated stack, and includes a plurality of holes (35) proximate the outer circumaference of the midplate. A first series of yield pins (12T) are anchored to the top load plate and extended downwardly toward the bottom load plate, and a second series of yield pins (12B) are anchored to the bottom load plate and extend upwarlly towards to the top load plate. The yield pins (12T, 12B) are received within the oversized holes (35) disposed about the periphery of the midplate. During lateral displacement of the bearing assembly, the midplate (14) deflects and plastically deforms the pins; upon cessation of the applied lateral force, the resilient bearing body urges the assembly back to its original position, plastically reforming the yield pins to their original position. The yield function of the yield pins is thus decoupled from the bearing and restoring function of the bearing body (13).

20 Claims, 4 Drawing Sheets

SEISMIC ISOLATION BEARING

CROSS-REFERENCE TO RELATED APPLICATIONS

This is a continuation-in-part (CIP) of U.S. patent application Ser. No. 08/156,550, filed Nov. 24, 1993, and entitled "Steel-Rubber Seismic Isolation Bearing," by the same inventor.

TECHNICAL FIELD

The present invention relates, generally, to seismic isolation bearings and, more particularly, to bearings which employ a rubber bearing body in conjunction with steel pin yielders.

BACKGROUND OF THE INVENTION

Seismic bearings, sometimes referred to as isolation bearings, are generally characterized by their bearing, conservative, and dissipative capacity.

More particularly, isolation bearings of the type typically used with bridges, buildings, machines, and other structures potentially subject to seismic phenomena are typically configured to support a bearing load, i.e., the weight of the structure being supported. In this regard, it is desirable that a particular seismic isolation bearing be configured to support a prescribed maximum vertical gravity loading at every lateral displacement position.

The conservative character of a seismic isolation bearing may be described in terms of the bearing's ability to restore displacement caused by seismic activity or other external applied forces. In this regard, a rubber bearing body, leaf spring, coil spring, or the like may be employed to urge the bearing back to its original, nominal position following a lateral displacement caused by an externally applied force. In this context, the bearing "conserves" lateral vector forces by storing a substantial portion of the applied energy in its spring, rubber volume, or the like, and releases this applied energy upon cessation of the externally applied force to pull or otherwise urge the bearing back to its nominal design position.

The dissipative character of an isolation bearing surrounds the bearing's ability to dissipate a substantial portion of an applied force, for example an applied force due to seismic activity. Typical dissipative modalities include the use of mating frictional surfaces, as well as the use of lead or steel members designed to plastically deform (yield) in response to the application of external forces. Ideally, the yielding members dissipate a portion of the applied energy, and are thereafter urged back to their original position through the action of the bearing's restoring (i.e., conservative) mechanism.

Presently known isolation bearings often employ a laminated rubber bearing body, reinforced with steel plates. More particularly, thin steel plates are interposed between relatively thick rubber plates, to produce an alternating steel/rubber laminated bearing body. The use of a thin steel plate between each rubber plate in the stack helps prevent the rubber from bulging outwardly at its perimeter in response to applied vertical bearing stresses. This arrangement permits the bearing body to support vertical forces much greater than would otherwise be supportable by an equal volume of rubber without the use of steel plates.

The aforementioned steel/rubber laminate bearing body is particularly useful in the context of bridges, buildings, and other large structures.

Steel coil springs combined with snubbers (i.e., shock absorbers) are often used in the context of machines to vertically support the weight of the machine. Coil springs are generally preferable to steel/rubber laminates in applications where the structure to be supported (e.g., machine) may undergo an upward vertical force, which might otherwise tend to separate the steel/rubber laminate.

Rubber bearings are typically constructed of high damping rubber, or are otherwise supplemented with lead or steel yielders useful in dissipating applied energy. Presently known metallic yielders, however, are disadvantageous in that they inhibit or even prevent effective vertical isolation, particularly in assemblies wherein the metallic yielder is connected to both the upper bearing plate and the oppositely disposed lower bearing plate within which the rubber bearing body is sandwiched.

Presently known seismic isolation bearings are further disadvantageous inasmuch as it is difficult to separate the viscous and hysteretic damping characteristics of a high damping rubber bearing; a seismic isolation bearing is thus needed which effectively decouples the viscous and hysteretic functions of the bearing.

Steel spring mounts of the type typically used in conjunction with machines are unable to provide energy dissipation, with the effect that such steel spring mounts generally result in wide bearing movements. Such wide bearing movements may be compensated for through the use of snubbers or shock absorbers. However, in use, the snubber may impart to a machine an acceleration on the order of or even greater than the acceleration applied to the machine due to seismicity.

For very high vertical loads, sliding type seismic isolators are often employed. However, it is difficult to control or maintain the friction coefficient associated with such isolators; furthermore, such isolators typically do not provide vertical isolation, and are poorly suited for use in applications wherein an uplift capacity is desired.

U.S. Pat. No. 4,644,714 discloses a friction type isolation bearing employing a rigid snubber.

U.S. Pat. Nos. 4,605,106 and 4,718,206 to Fyfe, et al. (1986 and 1988) disclose high damping rubber bearings. In these rubber bearings, the velocity and displacement related damping components are virtually inseparable, making them poorly suited for use as seismic isolators.

U.S. Pat. No. 4,117,637 discloses a rubber bearing used in connection with a lead core yielder. The lead core comprises a rigid body extending across the isolator which carries a significant portion of the vertical load, thus rendering vertical isolation difficult. A further disadvantage associated with this type of isolator has been observed when such bearings have been saw cut into cross-section, revealing that the lead is often pumped out of its core due to its softness under repeated compression and shear loadings.

Steel is generally more ductal than lead, and may thus be viewed as a more reliable yielder than lead. Several attempts have been made to use steel yielders in rubber bearings. For example, U.S. Pat. Nos. 4,727,695 (1988); 5,215,382 (1993); and 5,242,147 (1993) to the present inventor disclose the use of steel plate or dowel yielders in rubber bearings; however, these yielders do not provide uniform volumetric yielding, i.e., they do not provide for the substantial uniform distribution of the stresses within the yielding element. Consequently, such yielders tend to yield locally, i.e., within a discrete region of the yielder as opposed to distributing the yielding stress throughout the yielding member. That is, these yielding members may concentrate the applied stress in a discrete region of the yielder, for example near the base of the yielder, or near the point of applied stress. Consequently, low cycle fatigue tends to limit the number of times these bearings can balance seismic activity.

U.S. Pat. No. 4,910,930 (1990) to Way discloses an external coil yielder which yields locally, but which locality shifts during seismic activity (e.g., earthquakes).

U.S. Pat. No. 4,823,522 (1989) to White discloses uniform yielders, but which are capable of yielding in only one direction. As a result, their application is substantially limited to their use as supplemental dampers in interstories, and are not suitable for use as base isolators.

An Italian based company referred to herein as FIP has disclosed a sliding bearing used in connection with yielders which are apparently configured to partially distribute the yielding stress within the yielder. These yielders are configured to extend vertically through the bearing from the bottom bearing plate to the top bearing plate. Each yielder further includes a spherical ball head at its upper distal end, which essentially fixes the point at which lateral stresses may be applied to the yield pin. In conjunction with the fact that the ball head is received within a cylindrical opening in the oppositely disposed bearing plate, this configuration limits the extent to which the yielder may be displaced. This configuration further imposes unwanted tension on the yielder during displacement, degrading the strength of the yielder.

A further problem associated with presently known isolation bearings surrounds the use of yielders which are internal to the rubber bearing. While this configuration generally protects the yielder from corrosion, it is difficult and often impossible to inspect or otherwise verify the structural integrity of such an internal yielder without removing and/or destroying the bearing once it is installed.

Many presently known yielders also employ lead in great quantity. This is disadvantageous inasmuch as lead presents an environmental hazard. Moreover, many bearings are designed to be replaceable, which leaves the problem of disposal of the replaced lead in view of the environmental hazards associated with lead disposal. Consequently, many building codes tend toward bearing specifications which favor unleaded bearings.

A further environmental problem associated with presently known bearings involves the use of rubber. As is known, rubber manufacturing generally takes place remote from populated urban areas due to the nature of the gases emitted in the manufacturing process. In addition, the manufacture of rubber also involves the use of hazardous solvents. Thus, a bearing design which minimizes the extent to which new rubber plates must be manufactured is needed.

Moreover, rubber does not naturally dissolve well when disposed. Accordingly, a bearing is needed which may be made of revulcanized or recycled rubber, for example shredded tire flakes.

A seismic isolation bearing is thus needed which overcomes the shortcomings of the prior art.

SUMMARY OF THE INVENTION

The present invention provides seismic isolation bearings which overcome the shortcomings of the prior art.

In accordance with a preferred embodiment of the present invention, a seismic isolation bearing is provided which includes a flat planar upper bearing plate and an oppositely disposed flat planar lower bearing plate. In use, the upper bearing plate is secured to the machine, building, bridge, or other structure to be supported, while the lower bearing plate is secured to the frame, beam, foundation, or other datum upon which the structure rests.

In accordance with one aspect of a preferred embodiment of the present invention, a rubber bearing body is disposed between the upper and lower bearing plates, which bearing body may be secured to one or both of the upper and lower bearing plates, for example by vulcanization or through the use of an appropriate adhesive. Alternatively, the rubber bearing body may be unbonded to one or both of the upper bearing plates, thus reducing manufacturing costs. Such an unbonded configuration is particularly useful in applications where uplifting forces are not likely to be encountered.

In accordance with a preferred embodiment of the present invention, the rubber bearing body suitably comprises a series of alternating rubber and steel plates, wherein the steel plates are configured to limit outward radial bulging of the rubber plates as a result of the static friction at the steel/rubber surfaces.

In accordance with a further aspect of the present invention, the rubber bearing body may be substantially cylindrical, resulting in an omni-directional assembly; alternatively, the bearing body may exhibit any desired shape, for example, a rectangular shape useful in bridges, buildings, and the like. Although such rectangular bearing bodies typically are necessarily directional in use, they are generally less expensive to manufacture, inasmuch as square or rectangular plates are more easily fabricated from large sheets than is the case with circular plates.

In accordance with a further aspect of the present invention, the laminated rubber bearing body suitably includes an axial through hole extending vertically therethrough, the diameter of which may be modulated in accordance with the desired bearing strength of the device. For example, in applications involving large bearing forces (e.g., buildings), a relatively small diameter bore may be employed; alternatively, for extremely high bearing forces, the bore may be dispensed with entirely, resulting in maximum vertical bearing capacity. For lighter bearing loads or for applications involving machines and the like, a relatively large diameter through hole may be employed, resulting in a less stiff (i.e., a springy) bearing support.

In accordance with yet a further aspect of the present invention, a plurality of tapered pins are suitably anchored to each of the top and bottom bearing plates, and extend axially toward the opposing bearing plate. In a preferred embodiment, a midplate is incorporated into and extends radially outward from the rubber bearing body. The midplate suitably includes a plurality of oversized through holes, through which each of the aforementioned yield pins extend.

In accordance with a further aspect of the present invention, the height of the yield pins is substantially less than the nominal separation between the upper and lower bearing plates, such that the free distal ends of the yield pins do not contact the opposing bearing plate. In this way, the isolation bearing may effectively isolate the supported structure from vertical forces, yet the yield pins remain mechanically decoupled from the vertical isolation mechanism.

In accordance with yet a further aspect of the present invention, each yield pin, in response to lateral and/or torsional stresses, suitably contacts the perimeter of the hole in the midplate through which it extends, and may suitably deform plastically in response to applied stress. Once the externally applied stress is relieved, the rubber bearing body urges the assembly back into its nominal position (i.e., the rubber bearing body restores the assembly), whereupon the yield pins are again plastically deformed back to their initial configuration.

BRIEF DESCRIPTION OF THE DRAWING FIGURES

The aforementioned structure and functionality, in conjunction with additional features and embodiments, will hereinafter be described in conjunction with the appended drawing figures, wherein like designations denote like elements, and:

Figure 1:
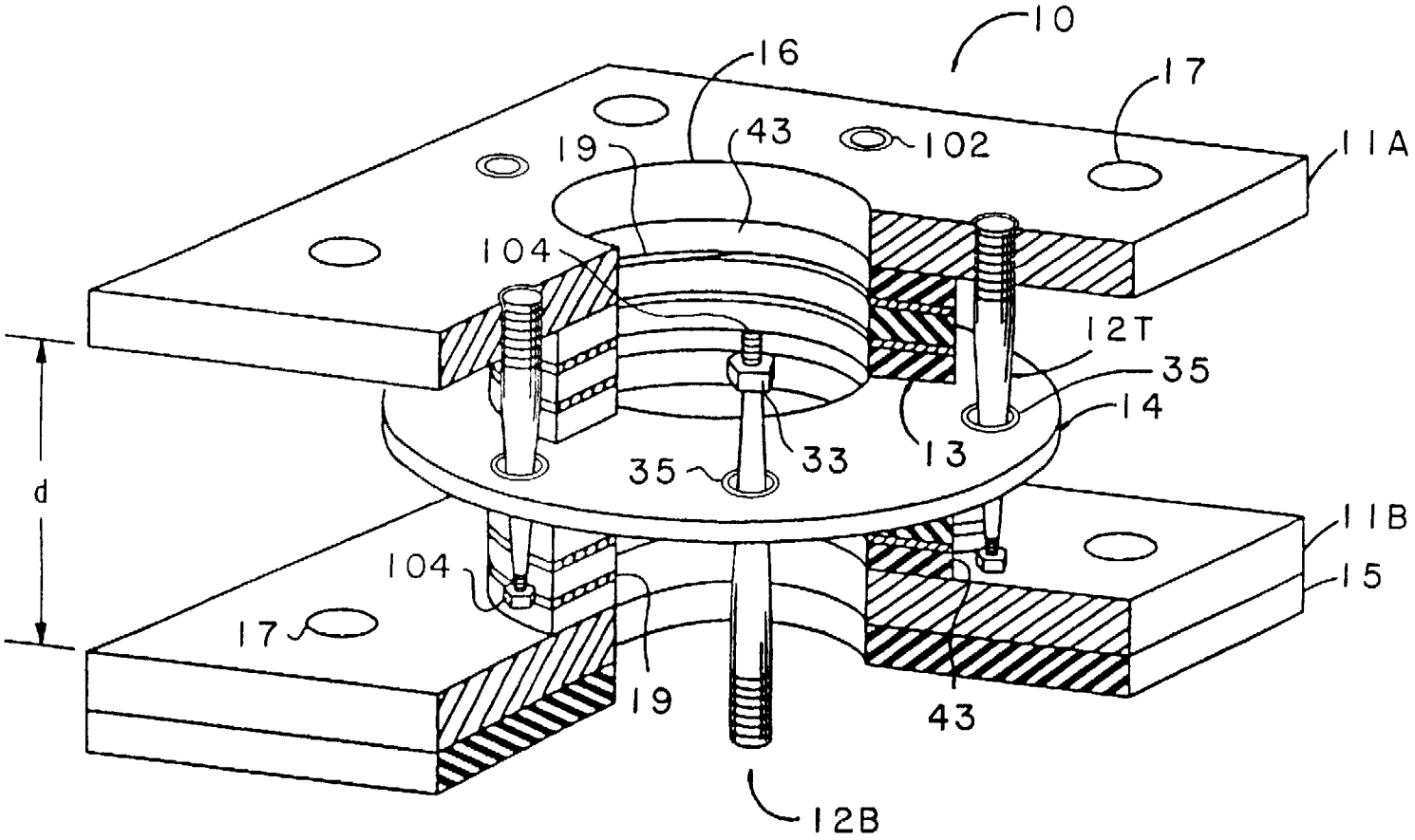
FIG. 1 is a perspective view of an exemplary seismic isolation bearing assembly in accordance with the present invention.
Figure 4A:
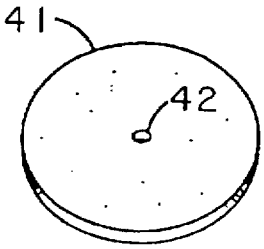
Figure 4B:
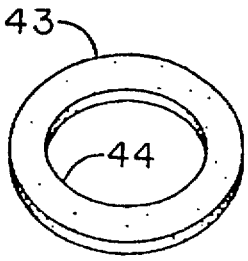
Figure 5A:
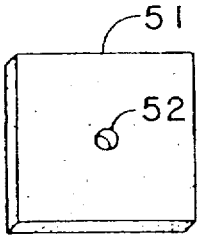
Figure 6A:
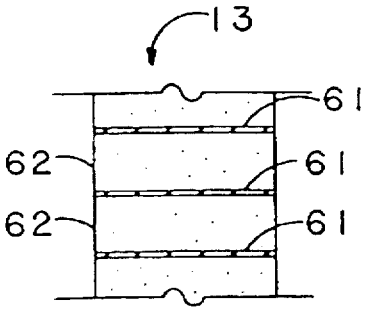
Figure 6B:
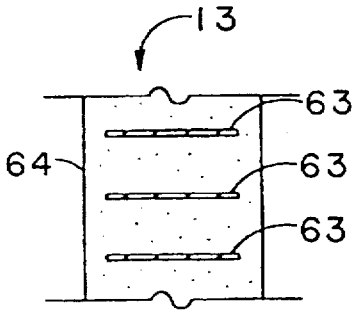
Figure 6C:
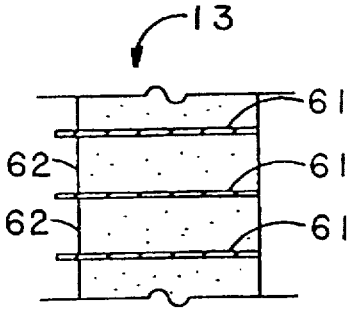
Figure 9:
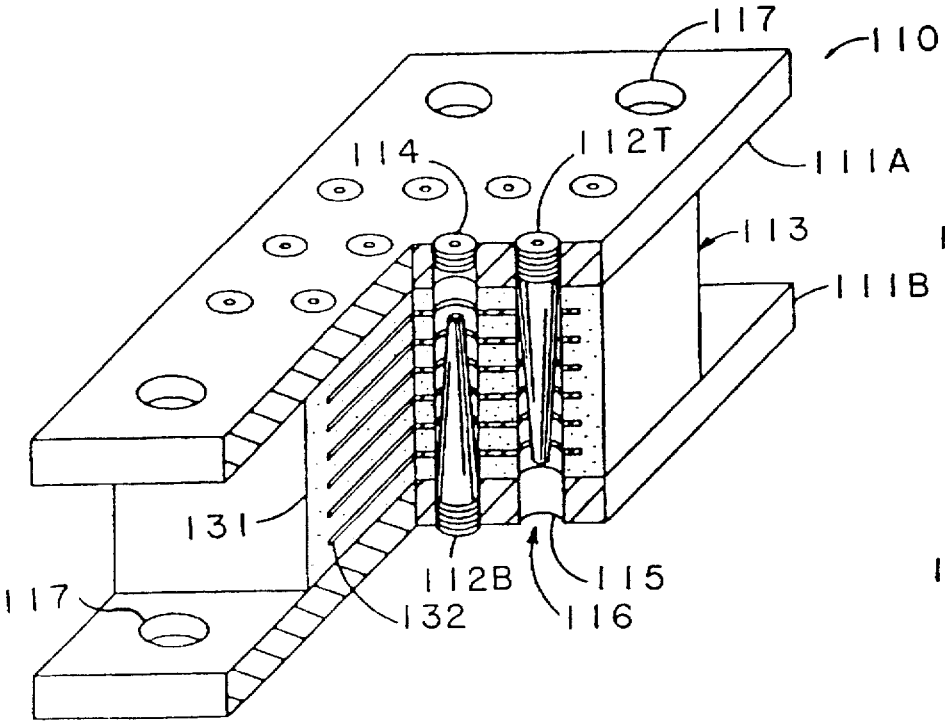
Figure 8:
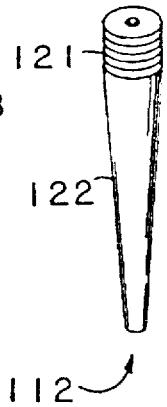
Figure 7A:
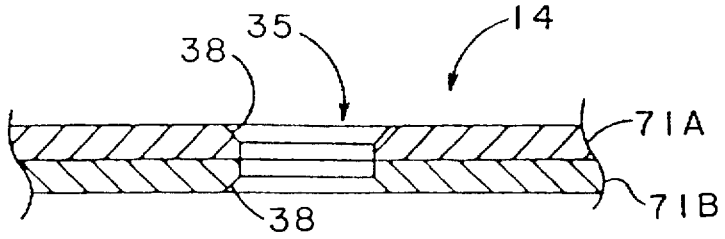
Figure 7B:
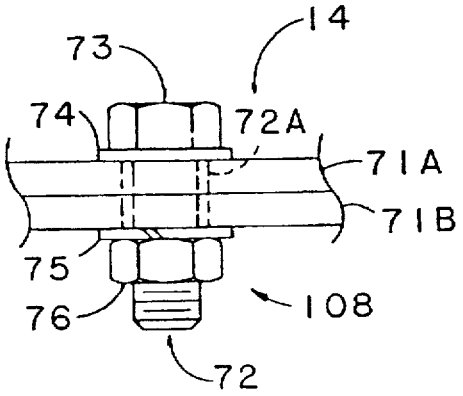
Figure 7C:
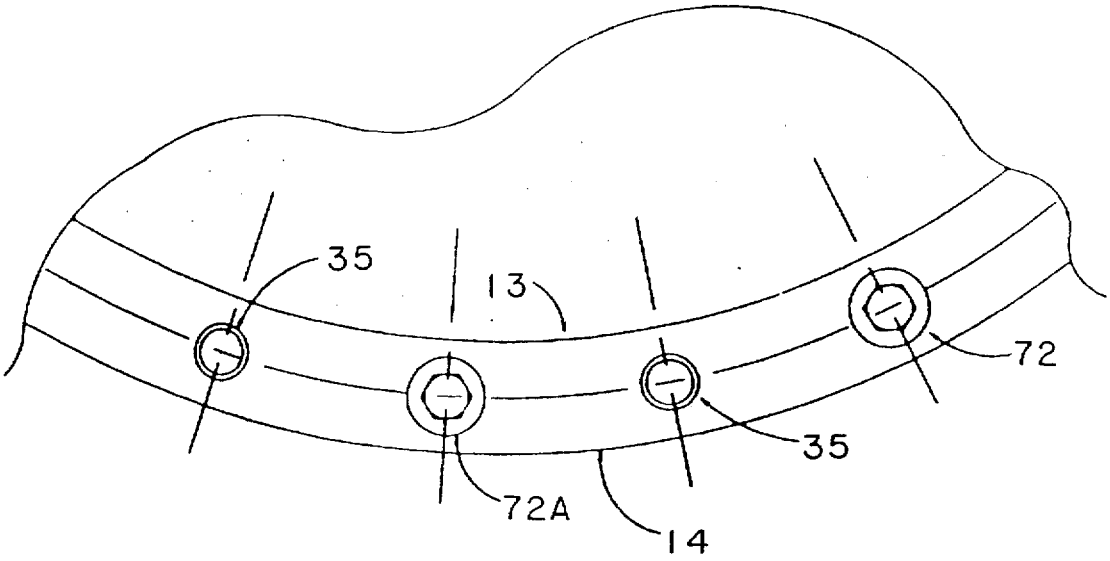

FIGS. 4A and B are perspective views of alternate embodiments of a rubber plate of the type shown in FIG. 1;

FIGS. 5A and B are alternate rectangular embodiments of the rubber plates shown in FIG. 4;

FIGS. 6A–C set forth various alternate embodiments of the shim/rubber laminate shown in FIG. 1;

FIG. 7A is a cross-section view of an alternate embodiment of the midplate shown in FIG. 1, illustrating a double plated composite midplate;

FIG. 7B is a side view of the plates of FIG. 7A shown bolted together;

FIG. 7C is a top partial view of the composite midplate of FIG. 7A;

FIG. 8 is a pin for use in connection with the unexposed pin embodiment shown in FIG. 9; and FIG. 9 is a perspective view of an alternate embodiment of an exemplary seismic isolation bearing in accordance with the present invention.

DETAILED DESCRIPTION OF PREFERRED EXEMPLARY EMBODIMENTS

Referring now to FIG. 1, a preferred embodiment of an exemplary seismic isolation bearing 10 suitably comprises an upper load plate 11A, a lower load plate 11B, and a bearing body 13 disposed therebetween. One or more yield pins 12T extend downwardly from upper load plate 11A; similarly, one or more yield pins 12B extend upwardly from lower load plate 11B.

Bearing body 13 suitably comprises a laminated stack of alternating rubber plates 43 and steel disks 19. In the context of the present invention, it will be understood that the term "rubber," particularly as regards rubber plates 43, includes any material including but not limited to rubber which exhibits the salient functional characteristics of rubber. For example, various resins, plastics, polymers, and combinations thereof may be employed in the context of body 13. Particularly appropriate materials include those which exhibit substantially elastic deformation throughout the desired displacement range of the bearing, and which provide adequate vertical (i.e., bearing) support for the load supported by assembly 10. In addition, the "rubber" material comprising body 13 is desirably sufficiently resilient to substantially restore the bearing assembly to its nominal design position (shown in FIG. 1) upon cessation of an externally applied (e.g., seismic) lateral stress.

Similarly, the term "steel" as used herein refers to any material which exhibits the desirable functional characteristics of steel, including the ability to bond to adjacent rubber plates, either through vulcanization, the use of adhesives, or via frictional engagement. By bonding or otherwise engaging rubber plates 43, the "steel" plates 19 permit rubber plates 43 to withstand substantial bearing loads without rupturing radially. In addition, the presence of "steel" plates 19 enhances the vertical stiffness and aggregate bearing strength of bearing body 13.

With continued reference to FIG. 1, body 13 further comprises a midplate 14 which, in the preferred embodiment illustrated in FIG. 1, extends radially from body 13. Although the preferred embodiment shown in FIG. 1 illustrates a laminated stack comprising three rubber plates 43 and two shim plates 19 on each side of midplate 14, it will be appreciated that any convenient number of rubber and steel plates may be employed; further, while midplate 14 is illustrated as being disposed within stack 13 midway between load plate 11A and load plate 11B, it will also be appreciated that midplate 14 may assume any desired position within the stack.

Midplate 14 suitably comprises a plurality of holes 35 through which respective pins 12T and 12B extend. In accordance with one aspect of the present invention, midplate 14 suitably comprises a steel plate of integral, unitary construction; alternatively, midplate 14 may be constructed as a composite, as discussed in greater detail below in connection with FIG. 7.

Figure 2:
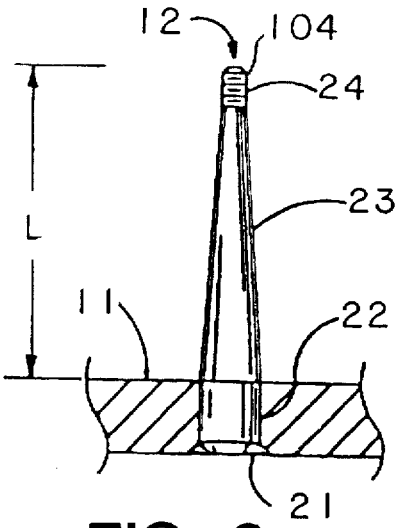
FIG. 2 is a detailed view of an exemplary embodiment of one of the pins shown in FIG. 1.

Referring now to FIGS. 1–2 and 4, respective pins 12T and 12B are suitably secured within respective corresponding holes 102 in load plate 11 by any convenient means. In the preferred embodiment set forth herein, each pin 12 is suitably secured to its load plate through the use of an adhesive bond 22, a weld bond 21, or both. Alternatively, pin 12 may be secured within hole 102 by threaded engagement, press fit, interference fit, or the like.

As best seen in FIG. 1, load plate 11A suitably comprises a plurality of anchor holes 17 for securing load plate 11A to the building, bridge, machine, or other structure to be supported by the bearing, for example, through the use of anchor bolts. Similarly, load plate 11B comprises a plurality of holes 17 for securing the assembly to the foundation, beam, concrete slab, floor, or the like. In this regard, although load plates 11A and 11B are referred to as upper and lower plates, respectively, it is understood that bearing assembly 10 may be employed in any suitable orientation, with the axis of body 13 disposed vertically, horizontally, or at any desired orientation as required by the particular application for which the bearing is employed. In certain applications, rubber layer 15 may be placed against or glued to load plate 11B as appropriate (e.g., for use with machines).

Bearing assembly 10 suitably includes an axial bore 16 extending therethrough. For applications involving relatively low bearing stresses, for example when bearing assembly 10 is used in connection with machines, the diameter of bore 16 may be relatively large; conversely, for more substantial bearing stresses, the diameter of bore 16 may be relatively small. For very large bearing stresses or where a high degree of stiffness is desired, bore 16 may be eliminated entirely.

As discussed above, seismic isolation bearings are conveniently described in terms of their bearing, dissipative, and conservative characteristics. In the preferred embodiment shown in FIG. 1, the primary load bearing mechanism involves body 13, wherein the stiffness and bearing capacity of the assembly is a function of, among other things, the number and thickness of respective rubber plates 43 and steel plates 19, the thickness of midplate 14, the size of bore 16, the geometric configuration of body 13 (e.g., cylindrical, rectangular), and the materials comprising the various components of bearing body 13. In accordance with one aspect of the present invention, respective pins 12B and 12T are mechanically decoupled from, and hence do not participate in, the vertical bearing function of assembly 10. Indeed, as the distance between respective load plates 11A and 11B decreases as a result of applied force which is either substantially vertical or which has a substantial lateral vector component causing shearing and/or torsional stresses in body 13, distal ends 104 are suitably configured such that they do not contact the inward-facing surface of the opposing load plate. Stated another way, the length of pins 12 is designed to be shorter than or equal to the distance between the inward-facing surfaces of load plates 11A and 11B for all displacement positions.

In accordance with a further aspect of the present invention, the exposed portion of each pin 12 is suitably on the order of 30–50%, and preferably about 41%, of the nominal distance between respective load plates 11A and 11B. Thus, for maximum design lateral displacement of assembly 10, for example when the vertical axis of body 13 is deflected on the order of 45° from the vertical, the length L (FIG. 2) of pin 12 is suitably less than or equal to the compressed distance d' between the inward-facing surfaces of load plates 11A and 11B.

The conservative character of bearing assembly 10 is a function of, among other things, the elasticity of bearing body 13. More particularly, as lateral forces are applied to assembly 10, bearing body 13 is elastically deformed; when the applied force terminates, the elastic character of body 13 desirably restores assembly 10 to its nominal position shown in FIG. 1.

The dissipative character of bearing assembly 10 involves the bending (yielding) of pins 12. More particularly, pins 12 exhibit a degree of elasticity at very low applied bending stresses. That is, as relatively small lateral forces are applied to assembly 10, the vertical axis of body 13 deflects from its nominal position shown in FIG. 1. As the magnitude of the applied lateral force increases, an exemplary pin 12 will contact a point in its corresponding hole 35, and deflect slightly. For relatively small deflections of pin 12, pin 12 deforms elastically and returns to its nominal position upon cessation of the applied stress.

For larger applied stresses, pin 12 contacts the perimeter of hole 35 and, as the magnitude of the applied stress increases, pin 12 plastically deforms as a result of the application of force to pin 12 by midplate 14 at the point of contact between pin 12 and hole 35, which contact point typically moves along the length of pin 12 as the magnitude of the applied stress increases and decreases. As a result of the plastic deformation (yielding) of respective pins 12, the applied energy is dissipated. When the external applied force ceases, body 13 is designed to urge bearing assembly 10 back to its nominal position. Thus, bearing body 13 is suitably sufficiently strong to reverse the plastic deformation of pins 12, and to plastically reform the pins back to or near their original, nominal position shown in FIG. 1. Those skilled in the art will appreciate, however, that hysteresis and other effects may result in a small degree of residual plastic deformation of pins 12 upon restoration.

As pins 12 plastically deform, applied energy is dissipated as a function of, among other things, the yield strength of pins 12. In contrast to many prior art bearings, however, respective pins 12T are mounted to load plate 11A and are deflected by midplate 14; similarly, respective pins 12B are mounted to load plate 11B and are also defected by midplate 14. As discussed above, pins 12B do not contact or otherwise directly interact with load plate 11A, and pins 12T do not contact or otherwise directly interact with plate 11B. In this way, the dissipative yielding function of bearing assembly is effectively isolated from the bearing function provided by bearing body 13.

In accordance with the preferred embodiment shown in FIG. 1, the number of pins 12T extending from plate 11A is equal to the number of pins 12B extending from plate 11B; alternatively, bearing assembly 10 may be configured such that any desired number of pins extend from one or more of plates 11A and 11B to accommodate desired performance characteristics.

Referring now to FIGS. 1–3, one or more of pins 12 are suitably configured to include a nut or other convenient fastener at the distal end thereof. In the preferred embodiment illustrated in FIGS. 1–3, pin 12 is threaded such that a nut 33 may be attached thereto.

Figure 3B:
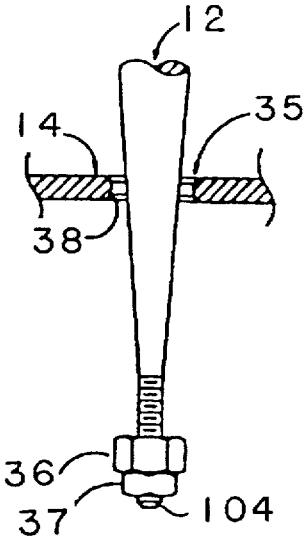
FIG. 3B is a partly cross-sectional detail view of one of the pins of FIG. 1, shown extending through an oversized hole in the middle bearing plate shown in FIG. 1.
Figure 3A:
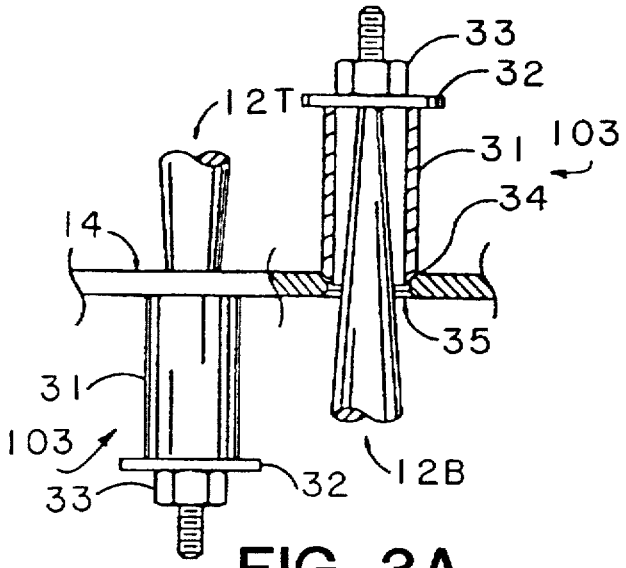
FIG. 3A is a cross-section view of an exemplary embodiment of a sleeve assembly useful in cold bonding manufacture of the rubber body assembly shown in FIG. 1.

With particular reference to FIG. 3A, one or more of pins 12T and 12B may be suitably employed in the context of a temporary press, for example to facilitate the gluing of a cold bonded bearing body. In addition, a temporary press may also be employed to facilitate transportation, handling, and installation of bearing assembly 10, as desired.

More particularly, bearing body 13 may suitably comprise revulcanized or otherwise recycled rubber particles, for example, rubber flakes derived from used automobile tires. In such cases, it is often convenient to cold bond rubber plates 43 to respective steel plates 19 and, in addition, it may also be desirable to cold bond one or both of the terminal rubber plates to one or both of load plates 11A and 11B. As discussed above, such cold bonding is desirably effected through the use of a suitable adhesive (e.g., Locktite™, epoxy, cyanide acrylate, polymer resins, and the like). Alternatively, one or more of rubber plates 43 may simply be unbonded to the adjacent steel plates 19 and, in addition, one or both of the terminal rubber plates 43 may be unbonded to one or both of load plates 11A and 11B.

With continued reference to FIG. 3A, an exemplary press 103 suitably comprises a temporary sleeve 31 having a conical chamfer 34, a washer 32, and nut 33. More particularly, the length of pipe sleeve 31, the thickness of washer 32, and the magnitude of torque applied to nut 33 may be configured to compress midplate 14 towards load plate 11A or load plate 11B. If desired, one or more of pins 12T and one or more of pins 12B may be equipped with a press assembly 103 to thereby facilitate cold bonding, transportation, handling, and installation of assembly 10. By permitting the use of recycled or revulcanized rubber, a more environmentally safe bearing assembly 10 may be produced inasmuch as, among other things, new rubber plates need not be vulcanized as is typically the case with presently known seismic isolation assemblies.

With continued reference to FIGS. 1–3, a nut or similar fastener disposed at the distal end of pin 12 may also function as a displacement limiter. More particularly, as external lateral forces are applied to bearing assembly 10, load plate 11A is displaced laterally with respect to load plate 11B, causing rubber body 13 to shear in the direction of the applied force. By placing a nut or other fastener at the distal end of the pin, such fastener will contact midplate 14 in the region of hole 35 as assembly 10 tends towards maximum displacement. In this way, nut 33 may function as a displacement limiter for the assembly. With particular reference to FIG. 3B, it may also be desirable to employ a lock nut configuration comprising a first nut 36 and a second, locking nut 37 at the threaded end of pin 12 to thereby minimize the effects of vibration, loading, and the like on the position of nut 36. As applied lateral stresses approach the maximum design shear for the assembly, nut 36 will "lock" into hole 35, thereby preventing further lateral displacement of assembly 10 and limiting the maximum displacement of the assembly.

With continued reference to FIGS. 1 and 3B, hole 35 is suitably larger in diameter than pin 12, to thereby provide a clearance between pin 12 and plate 14. This clearance permits relatively low level lateral forces to be applied to bearing assembly 10 without causing pin 12 to contact the edge of hole 35. Such low level lateral stresses may result from wind, braking, centrifugal forces, dimensional changes due to thermal expansion and contraction, creep, relaxation, and other non-seismic actions, as well as relatively low level seismic activity. Such low level activity is particularly prevalent in machines which experience low amplitude vibrations.

With continued reference to FIG. 3B, hole 35 suitably comprises a circumferential chamfer 38 which reduces local stress concentrations on pin 12 as the pin contacts the perimeter of hole 35. In a particularly preferred embodiment, chamfer 38 is disposed at an angle with respect to the plane of midplate 14 on the order of 20°–60°, and most preferably in the range of about 45°. At maximum lateral displacement of assembly 10, wherein nut 33 (or nut 36 as shown in FIG. 3B) engages the under surface of midplate 14 proximate hole 35, the longitudinal axis of pin 12 at the distal portion thereof is oriented at approximately a 45° angle with respect to the plane of midplate 14. Chamfer 38 further reduces stress concentrations in pin 12 at this maximum locking position.

With continued reference to FIGS. 1 and 3B, as lateral forces are applied to assembly 10, each of respective pins 12 engage a point on the perimeter of its corresponding hole 35, and pin 12 slides against the edge of hole 35 as applied stresses increase and decrease. At any given instant in time, the point or region of contact between pin 12 and midplate 14 (the outside perimeter of hole 35) essentially defines the point of applied force along the length of pin 12. In order to further reduce stress concentrations within pin 12, the pin's cross-section relative to the distance from the base of pin 12 to the point of contact with midplate 14 is suitably configured to provide volumetric yielding of the pin throughout a range of displacements of rubber body 13. In a particularly preferred embodiment, substantially uniform volumetric yielding of pin 12 occurs throughout the entire range of shear displacement.

In the context of the present invention, it is desirable to configure the cross-section and profile of pin 12 such that the application of force to pin 12 by midplate 14 does not result in stress concentrations, for example stress concentrations which might otherwise appear at the base of pin 12 (i.e., where pin 12 is affixed to plate 11), at the point of contact between pin 12 and midplate 14, or at other local stress concentration regions within pin 12. Rather, it is desirable that the stress be distributed throughout a substantial portion of the volume of pin 12, and preferably uniformly throughout substantially the entire volume of pin 12.

To achieve such volumetric yielding within pin 12, the contour of pin 12, i.e., the shape of a curve within a single plane extending from the base of the pin to the threaded portion of the pin, suitably comprises a cubic root function. Such a curve may be approximated by the following equation:

$$R=A(I)^n$$

Where R is the radius of pin 12 at a particular point along the length of pin 12, A is a proportional constant, I is the instantaneous length of pin 12 from the base of the pin to the point of contact (corresponding to the point at which the radius "R" is defined), and n is a cubic root value on the order of ⅓. Although a cubic root function is employed in a particularly preferred embodiment, any suitable profile may be conveniently employed in the context of the present invention which facilitates the distribution of yielding within pin 12. For example, although a cubic root is desired, the value of "n" in the above equation may suitably range from ¼ to ½. Indeed, virtually any desired profile of pin 12, in conjunction with any desired configuration of the perimeter of hole 35, which effectively distributes the yielding stresses within pin 12 may be employed in the context of the present invention. In the preferred embodiment set forth in FIG. 3B, the profile of pin 12 suitably comprises a transitive curve between a cubic root function and a straight line taper.

The use of pin configurations which distribute the yielding within the volume of pin 12 facilitates high energy dissipation within the pin, and further facilitates the pins ability to withstand repeated bending cycles of the type imposed by repeated earthquakes.

Referring now to FIG. 4B, an exemplary rubber layer 43 is suitably circular in plan having a fairly large diameter hole 44 corresponding to bore 16 in FIG. 1. Rubber plates of such an annular configuration are relatively soft in terms of vertical bearing strength, analogous to the pitch of a coil spring. Vertical softness is desirable when bearing assembly 10 is used in conjunction with vibrating machines, such that assembly functions as a vibration isolator (or base isolator) for such machines.

Referring now to FIG. 4A, an alternate rubber layer 41 is shown having a relatively small diameter hole 42. As stated above, the central hole within a rubber (or steel) plate comprising bearing body 13 may be of any suitable diameter, including a zero diameter (i.e., no hole). Such rubber plates are relatively stiff, and are thus desirable for use in connection with bridges, buildings, and other structures. In accordance with a further aspect of the present invention, even in applications where maximum stiffness is desired, it may nonetheless be convenient to incorporate at least a very small hole 42 in the rubber (and steel) plates comprising bearing body 13, to accommodate a threaded assembly rod, smooth mold centering pin, or the like to facilitate assembly, transportation, and/or installation of bearing assembly 10.

Figure 5B:
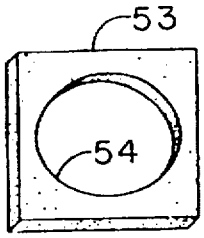

Referring now to FIG. 5, an alternative embodiment of rubber plates for use in bearing body 13 suitably comprise respective rectangular rubber plates 51 and 53, having corresponding small and large diameter holes 52 and 54 associated therewith. The relatively stiff rubber plate 51 is useful in connection with bridges and buildings, whereas the relatively soft plate 53 is particularly useful in conjunction with light structures, machines, and the like. The regular polygon plan shape (e.g., rectangular, square) of plates 51 and 53 facilitates manufacture of bearing assembly 10, inasmuch as rectangles and other regular polygons may be conveniently cut from large, flat sheets of rubber. Moreover, the rectangular construction shown in FIG. 5 may be more stable in shear than the cylindrical bearing body shown in FIG. 1 for a given displacement. Referring now to FIG. 6, FIG. 6A illustrates a bearing body 13 having steel shims 61 (analogous to steel plates 19 in FIG. 1) sandwiched between rubber layers 62 (analogous to rubber layers 43 of FIG. 1). Respective shims 61 and rubber layers 62 are illustratively flush at the vertical walls of body 13. Such a construction is economical, particularly in the context of polygonal plates, inasmuch as the flush surfaces facilitate convenient assembly of the bearing body.

FIG. 6B illustrates bearing body 13 with respective shims 63 imbedded within a rubber body 64. Such an embodiment is particularly advantageous in that respective shims 63 are protected from corrosion, as may be required by many building codes today for buildings and bridges.

FIG. 6C illustrates a bearing body 13 comprising respective steel shims 61 extending from body 13 and sandwiched in between rubber layer 62. Such shim plate extensions may be advantageously employed in the outer side of machine based isolators, to thereby provide extra support for stability at wide bearing shear positions.

Referring now to FIGS. 7A–7C, an alternate embodiment of midplate 14 suitably comprises a first subplate 71A and a second subplate 71B, each comprising a hole corresponding to hole 35. The composite assembly shown in FIG. 7A permits the assembly of bearings from two parts, which facilitates the manufacture of relatively large bearings by overcoming the limitations associated with vulcanization of large volumes of rubber as discussed in greater detail below. As shown in FIG. 7A, a single circumferential chamfer 38 suitably appears on each of plates 71A and 71 B, resulting in a composite chamfer configuration analogous to that shown in FIG. 3B.

FIG. 7B shows the double plate configuration of 7A bolted together with a fastener assembly 108, suitably comprising a bolt 72 having a head 73, respective washers 74 and 75, and a nut 76. In a preferred embodiment, respective washers 74 and 75 are suitably locking washers. Respective plates 71A and 71B may also be welded together along part or all of their common circumferential interface, either in addition to or in lieu of bolt assembly 108. While welding would provide additional strength, it would impede disassembly, as may be necessary for inspection, replacement, and the like.

FIG. 7C illustrates a plan arrangement of the double midplate configuration shown in FIGS. 7A and 7B. In accordance with a preferred embodiment, respective holes 72A which receive respective bolts 72 are interposed between respective holes 35. In accordance with a particularly preferred embodiment, respective holes 72A are preferably disposed radially about the axis of bearing body 13, approximately midway between respective holes 35.

The double plate configuration shown in FIGS. 7A–7C is particularly advantageous in several respects. Specifically, it may be desirable to vulcanize the rubber plates comprising bearing body 13 to the various steel plates comprising body 13, as well to one or both of load plate 11 and midplate 14. As is known, vulcanization generally involves compressing the rubber/steel assembly and heating the assembly under pressure. However, the size of such vulcanized bearings are limited in accordance with the maximum volume and heat absorption capacity of the unvulcanized rubber compound. Thus, particularly for very large bearings, the volume of rubber and other processing parameters, including, among other things, the physical size of the furnace, may limit the size of the bearing which can be effectively vulcanized. The use of the double midplate assembly shown in FIG. 7 permits the manufacture of seismic isolation bearings in two components, namely, a first half associated with midplate 71A and a second half associated with midplate 71B.

With momentary reference to FIG. 1, it will be appreciated that the use of a composite midplate 14 may be viewed as the junction between two half bearing sections, with each section comprising a single midplate 71A or 71B, a plurality of rubber plates 43 and steel plates 19, and an end load plate 11. With each section assembled and vulcanized separately, current limitations on the volume of rubber which can be vulcanized in one step are overcome. Once the respective bearing sections are vulcanized, they may be mated as shown in FIG. 7, resulting in a single bearing assembly such as shown in FIG. 1.

Referring now to FIGS. 8 and 9, an alternate embodiment of the present invention suitably includes yield pins which are internal to the bearing body, thus isolating the pins from the environment. Such a configuration is particularly useful in bridges and buildings and other corrosive environments, such that the yield pins remain protected from corrosion.

An alternate seismic isolation bearing 110 suitably comprises a first load plate 111A, a second load plate 111B, and a bearing body 113 sandwiched therebetween. Respective load plates 111A and 111B suitably include respective anchor holes 117 for anchoring the bearing assembly to the foundation and to the structure to be supported. In addition, respective load plates 111A and 111B further comprise a plurality of holes 116 within which the base of a pin 112 may be anchored. In the embodiment shown in FIG. 9, respective holes 116 in each of respective load plates 111A and 111B are axially aligned, such that a cylindrical bore 115 extends from top plate 111A through bearing body 113, terminating at lower plate 111B. Alternatively, the various holes 116 in upper and lower plates 111A and 111B need not be aligned with one another, such that cylindrical bore 115 within bearing body 113 need only extend a sufficient length to accommodate the height of pin 112, plus a sufficient clearance such that the length of pin 112 is either equal to or less than the compressed distance between plates 111A and 111B during maximum shear displacement of assembly 110.

With continued reference to FIG. 9, a plurality of pins 112T suitably extended downwardly from upper plate 111A, and a plurality of pins 112B suitably extend upwardly from bottom plate 111B. For each pin 112 within bearing body 113, the diameter of the cylindrical bore 115 within bearing body 113 should be sufficiently large to accommodate various non-seismic and other relatively small lateral deflections of assembly 110 such that pin 112 does not contact the cylindrical wall 115 in bearing body 113 within which the pin is received. On the other hand, the diameter of cylindrical bore 115 within bearing body 113 for each of pins 112 should be sufficiently small to ensure contact between at least one point along the length of pin 112 and the cylindrical bore comprising bearing body 113 during more substantial lateral deflections.

Bearing body 113 suitably comprises a plurality of steel plates 132 imbedded within rubber body 131. In accordance with an alternate embodiment not shown, one or more of respective steel plates 132 advantageously includes a hole having an axis coincident with cylindrical bore 115, with the diameter of the hole being smaller than the diameter of cylindrical bore 115. In this way, the small diameter hole comprising steel plate 132 may function analogously to hole 35 in midplate 14, as discussed above in conjunction with FIG. 1.

Respective pins 112 may be secured within plates 111A and/or 111B through any convenient mechanism, for example, soldering, adhesive, press fit, or threaded engagement. In the preferred embodiment shown in FIGS. 8 and 9, one or more of respective pins 112 comprise a threaded base portion 121 and a threadless taper 122.

In accordance with a further aspect of the illustrated embodiment, respective holes 116 which are not used for anchoring a pin 112 may be plugged with a threaded plug 114. In addition, the cylindrical bore within which pin 112 is disposed may be filled with a suitable filler, for example, silicon rubber or other elastomeric caulking material (not shown).

Although the yield pins are internal to the bearing body in FIG. 9, the seismic isolation mechanisms of bearing assembly 110 remain generally analogous to those discussed above in connection with FIG. 1. For example, the bearing pins 112 do not ordinarily participate in the normal bearing function of bearing assembly 110; rather, bearing body 113 performs the bearing function of the assembly, independent of the presence of pins 112. Specifically, although pins 112B are anchored to bottom plate 111B, they do not contact plate 111A; similarly, pins 112T anchored to plate 111A do not contact or otherwise interact with plate 111B, except, for example, in an alternate embodiment in which the distal ends of the pins are designed to contact the opposing load plate (or plug) during maximal lateral (shear) displacement.

During shear displacement, the inside surface of cylinder 115, i.e., the interior portion of body 113 bounded by cylinder 115, contacts and deflects pin 112 in much the same way the perimeter of hole 35 deflects pin 12 (see FIG. 1).

The profiles of respective pins 112 may also be generally analogous to the profiles of pins 12 discussed in conjunction with FIGS. 1 and 3, such that the yielding of the pins is substantially uniformly distributed throughout the volume of the pins.

For the various embodiments discussed herein including those illustrated in FIGS. 1 and 9, when the bearing assembly is bolted between the structure or machine and its foundation, it is anticipated that the ground which supports the lower load plate will from time to time shake with the foundation due to seismicity. The mass above and supported by the isolation bearing (building, bridge, and the like) will remain relatively stationary due to its inertia. As a result, a relatively wide vibratory shear movement (as opposed to structural deflections) will occur across the bearing assembly, which movement slowly decays after the earthquake is over. The more energy which is dissipated by the yield pins, the sooner the motion will stop and the smaller the isolator movement will be. Seismic isolation (seismic force reduction) is achieved by, among other things, the lateral softness or stiffness of the rubber bearing body. That is, the rubber bearing body provides motion decoupling, as well as displacement restoring. As a result of the restorative properties of the bearing body, the bearing assembly returns to at or near its original pre-deformation state after the earthquake subsides.

In the embodiments where the yield pins are external to the bearing body, the pins may be inspected in situ. In embodiments wherein the yield pins are internal to the bearing body, they may nonetheless be inspected, for example, by simply removing the yield pin from the load plate to which it is anchored.

In the context of the embodiment shown in FIG. 1, it can be seen that the various pins 12 intersect the common plane defined by midplate 14, regardless of whether the yield pins extend upwardly from the bottom plate or downwardly from the top plate. For a bearing assembly which is substantially symmetric about midplate 14, the various yield pins will undergo approximately the same plastic deformation and reformation during lateral shear and restoration. To the extent the internal embodiment shown in FIG. 9 is also substantially symmetric about a plane bisecting bearing body 113, this same phenomenon can be anticipated.

Although the invention has been described herein in conjunction with the appended drawing figures, the scope of the invention is not so limited. For various modifications in the design, selection, and arrangement of the various components and steps discussed herein may be made without departing from the spirit of the invention as set forth in the appended claims.

I claim:

1. A method for isolating and supporting a bearing load, comprising:

providing an upper load plate having a first downwardly facing surface;

providing an oppositely disposed lower load plate having a second upwardly facing surface;

providing a reinforced rubber bearing body extending between and contacting said first and second surfaces;

providing a mid plate disposed approximately midway between and substantially parallel to said first and second surfaces and having a distal portion which extends radially beyond said body, said distal portion including a plurality of holes formed therein;

providing at least one first yield pin extending substantially orthogonally from said first surface, through a first one of said holes, and having a first distal end terminating between said first hole and said second surface;

providing at least one second yield pin extending substantially orthogonally from said second surface, through a second one of said holes, and having a second distal end terminating between said second hole and said first surface;

resiliently deflecting said body in response to an externally applied lateral force such that said first and second pins are engaged by said distal portion of said mid plate thereby plastically deforming said pins.

2. The method of claim 1, further providing a plurality of said first and second yield pins extending from each of said first and second surfaces respectively, each of said first and second yield pins extending through one of said first and second holes respectively.

3. The method of claim 2, wherein the step of providing a plurality of said first yield pins extending from said first surface comprises providing a plurality of said first yield pins equal to the number of said second yield pins extending from said second surface.

4. The method of claim 1, wherein said step of providing said bearing body further provides said bearing body which is substantially cylindrical, and wherein said step of providing said mid plate comprises providing a mid plate which is a substantially flat, circular disk, and further wherein said distal portion of said mid plate comprises the outer perimeter of said mid plate.

5. The method of claim 1, wherein said step of providing said bearing body comprises providing a bearing body which includes a laminated stack of steel and rubber plates.

6. The method of claim 1, wherein said step of providing said bearing body comprises providing a bearing body which includes an annulus extending between said first and second surfaces, said body comprising a plurality of laminated rubber and steel annular disks.

7. The method of claim 1, wherein said step of providing includes providing each of said yield pins which is tapered from the point of attachment to said load plate to said distal end.

8. The method of claim 1, wherein said step of providing includes providing each of said yield pins which is tapered along its length in accordance with a cube root function.

9. The method of claim 1, wherein said step of providing includes providing each of said yield pins which is configured to distribute yielding stresses throughout a substantial portion of the volume of said yield pin.

10. The method of claim 1, wherein said step of providing includes providing each of said yield pins which is tapered in accordance with a cube root profile such that forces applied to said yield pin by said mid plate result in substantially uniform yield stresses throughout the volume of said yield pin.

11. The method of claim 1, wherein said step of providing said first and second yield pins comprises providing said first and second distal ends having a fastener configured to engage said mid plate at a maximum design lateral displacement of said bearing assembly.

12. The method of claim 1, wherein said step of providing said bearing body comprises providing a bearing body which is substantially rectangular.

13. The method of claim 1, wherein said step of providing said mid plate comprises providing said mid plate having two substantially similar, mating subplates, both rigidly secured together to form an integral structure.

14. The method of claim 13, wherein said method further comprises providing a laminated stack of steel and rubber plates, and wherein one of said rubber plates is at adjacent and vulcanized to one of said subplates, and another one of said rubber plates is at adjacent and vulcanized to another one of said subplates.

15. A method for seismic isolation of bridges, buildings and machines comprising:

providing a steel reinforced rubber bearing body sandwiched between a first and second bearing load plates;

providing a plurality of exposed and tapered steel pin yielders, uniform yielders, fixed to each of said first and second bearing load plates; and providing a mid plate, embodied in said bearing body, said mid plate having a plurality of holes, said yielders extending from said first and second bearing load plates and through said holes.

16. The method of claim 15, wherein said step of providing said yielders comprises providing said yielders having threaded pin ends.

17. The method of claim 16, further providing locknuts configured to engage said threaded pin ends.

18. The method of claim 15, wherein said step of providing said body includes providing said body having a vertical, central through hole.

19. The method of claim 15 where said step of providing said mid plate comprises providing said mid plate having two sub plates bolted together.

20. The method of claim 15, further providing a rubber plate mounted to an outside facing surface of one of said load plates.

* * * * *